US007836837B2

(12) United States Patent
Torii

(10) Patent No.: US 7,836,837 B2
(45) Date of Patent: Nov. 23, 2010

(54) EMBROIDERY DATA PROCESSING APPARATUS, EMBROIDERY DATA PROCESSING PROGRAM, AND RECORDING MEDIUM

(75) Inventor: Kentaro Torii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 428 days.

(21) Appl. No.: 12/071,040

(22) Filed: Feb. 14, 2008

(65) Prior Publication Data

US 2008/0196644 A1 Aug. 21, 2008

(30) Foreign Application Priority Data

Feb. 15, 2007 (JP) ..... 2007-034973

(51) Int. Cl.
*D05B 19/02* (2006.01)
*D05C 5/02* (2006.01)

(52) U.S. Cl. ..... 112/102.5; 700/138

(58) Field of Classification Search ..... 112/102.5, 112/470.01–470.06, 475.18, 475.19; 700/136–138
See application file for complete search history.

(56) References Cited

U.S. PATENT DOCUMENTS 4,413,574 A * 11/1983 Hirota et al. ..... 112/470.04
5,896,822 A * 4/1999 Futamura ..... 112/102.5
6,161,491 A * 12/2000 Takenoya et al. ..... 112/102.5
6,237,516 B1 * 5/2001 Wakayama ..... 112/102.5
6,584,921 B2 * 7/2003 Laufer et al. ..... 112/475.19
6,587,745 B1 * 7/2003 Polden et al. ..... 700/138

FOREIGN PATENT DOCUMENTS

| | | |
|---|---|---|
| JP | A 05-49769 | 3/1993 |
| JP | A 06-296777 | 10/1994 |
| JP | A 07-308470 | 11/1995 |
| JP | A 09-176955 | 7/1997 |
| JP | A 10-31471 | 2/1998 |
| JP | B2 3333579 | 7/2002 |

* cited by examiner

*Primary Examiner*—Ismael Izaguirre
(74) *Attorney, Agent, or Firm*—Oliff & Berridge, PLC

(57) ABSTRACT

An embroidery data processing apparatus includes a main data loading device that loads main data, which is original data of a principal pattern, and a main data disposition device that disposes in an embroidery sewing region the main data loaded by the main data loading device. The apparatus also includes a sub-data loading device that loads sub-data, which is original data of one or more patterns other than the principal pattern, and a sub-data disposition determination device that determines a position and a size of the sub-data loaded by the sub-data loading device, in accordance with a position and a size of the main data disposed by the main data disposition device. The apparatus further includes an embroidery sewing data generating device that generates embroidery sewing data based on the main data disposed by the main data disposition device and the sub-data determined by the sub-data disposition determination device.

12 Claims, 10 Drawing Sheets

EMBROIDERY DATA PROCESSING APPARATUS, EMBROIDERY DATA PROCESSING PROGRAM, AND RECORDING MEDIUM

CROSS-REFERENCE TO RELATED APPLICATION

This Application claims priority from Japanese Patent Application No. 2007-034973, filed Feb. 15, 2007, the disclosure of which is hereby incorporated herein by reference in its entirety.

BACKGROUND

The present disclosure relates to an embroidery data processing apparatus, an embroidery data processing program, and a computer-readable recording medium in which the embroidery data processing program is recorded.

Conventionally, in sewing a pattern with a sewing machine, there has been a need to combine a plurality of pattern data pieces to sew a desired pattern. For example, Japanese Patent Application Laid Open Publication No. Hei 5-49769 describes a pattern data processing apparatus for a sewing machine. This apparatus prepares in advance a plurality of frame patterns which have set data about positions where concrete patterns and character patterns are disposed. When any of the concrete and character patterns corresponding to a frame pattern is selected, the selected concrete and character patterns are disposed in accordance with the position data which is set to that frame pattern. Further, according to an embroidery pattern designing method and apparatus described in Japanese Patent Application Laid Open Publication No. Hei 9-176955, a plurality of drawings and photos are loaded using a scanner so that images may be edited and combined appropriately on a screen, thereby forming embroidery pattern data.

However, the apparatus described in No. Hei 5-49769 can dispose a pattern only to a position which is set beforehand and cannot edit the disposed pattern to a desired position. The method and apparatus described in No. Hei 9-176955 can edit a pattern in a desired form, but an operator must manually determine the pattern's position and size before editing, resulting in a labor consuming job. In particular, if it is desired to dispose a principal pattern at a center and accessory patterns around the principal pattern, as in the case of disposing some patterns around photo embroidery, it is desirable to reduce the labor of editing.

SUMMARY

Various exemplary embodiments of the principles described herein provide an embroidery data processing apparatus and an embroidery data processing program that can automatically dispose accessory patterns in such a manner that they may match a desired principal pattern.

Exemplary embodiments provide an embroidery data processing apparatus that generates embroidery sewing data required for sewing an embroidery pattern. The apparatus includes a main data loading device that loads main data, which is original data of a principal pattern, a main data disposition device that disposes in an embroidery sewing region the main data loaded by the main data loading device, a sub-data loading device that loads sub-data, which is original data of patterns other than the principal pattern, a sub-data disposition determination device that determines a position and a size of the sub-data loaded by the sub-data loading device, in accordance with a position and a size of the main data disposed by the main data disposition device, and an embroidery sewing data generating device that generates embroidery sewing data based on the main data disposed by the main data disposition device and the sub-data determined by the sub-data disposition determination device.

Exemplary embodiments also provide an embroidery data processing program recorded in a computer-readable recording medium. The program includes instructions that cause a controller to perform a main data loading step of loading main data, which is original data of a principal pattern, a main data disposition step of disposing in an embroidery sewing region the main data loaded in the main data loading step, a sub-data loading step of loading sub-data, which is original data of patterns other than the principal pattern, a sub-data disposition determination step of determining a position and a size of the sub-data loaded in the sub-data loading step, in accordance with a position and a size of the main data disposed in the main data disposition step, and an embroidery sewing data generating step of creating embroidery sewing data based on the main data disposed in the main data disposition step and the sub-data determined in the sub-data disposition determination step.

BRIEF DESCRIPTION OF THE DRAWINGS

Exemplary embodiments will be described below in detail with reference to the accompanying drawings in which.

DETAILED DESCRIPTION

Figure 1:
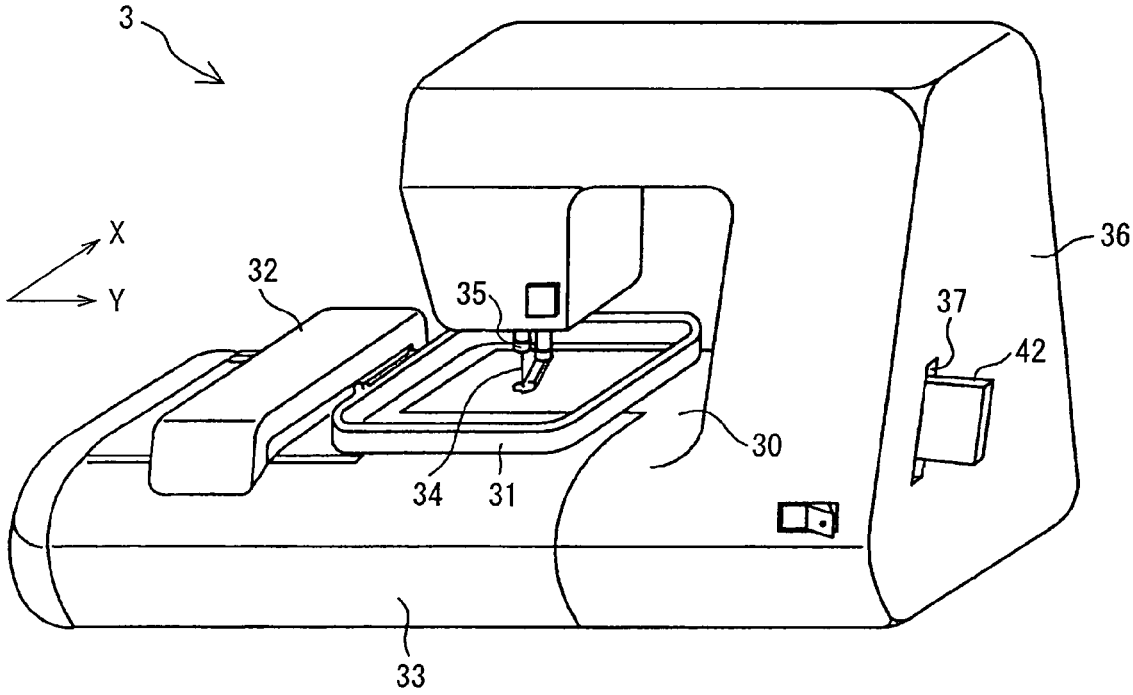
FIG. 1 is an external view of an embroidery sewing machine.

An exemplary embodiment of an embroidery data generating apparatus 1 according to the present disclosure with reference to the drawings is described below. The embroidery data generating apparatus 1 in the present embodiment generates embroidery data required for performing embroidering using an embroidery sewing machine 3 based on a plurality of image data pieces. First, the embroidery sewing machine 3 shown in FIG. 1 is described below.

On a sewing machine bed 30 of the embroidery sewing machine 3, an embroidery frame 31 is disposed. The embroidery frame 31 is moved to a predetermined position represented by an XY coordinate system that is particular to the apparatus by a Y-directional drive section 32 and an X-directional drive mechanism which is contained in a body case 33. A piece of work cloth to be embroidered is held on the embroidery frame 31 so that a piece of embroidery of a predetermined design may be sewn onto the piece of work cloth by using a sewing needle 34 and a shuttle mechanism (not shown). The Y-directional drive section 32, the X-directional drive section, a needle bar 35, and the shuttle mechanism are controlled by a control apparatus disposed in the embroidery sewing machine 3. A memory card slot 37 is provided on a side surface of a pillar 36 of the embroidery sewing machine 3. By inserting a memory card 42 storing embroidery data into the memory card slot 37, the embroidery data generated and stored in the memory card 42 by the embroidery data generating apparatus 1 is supplied to the embroidery sewing machine 3.

Figure 2:
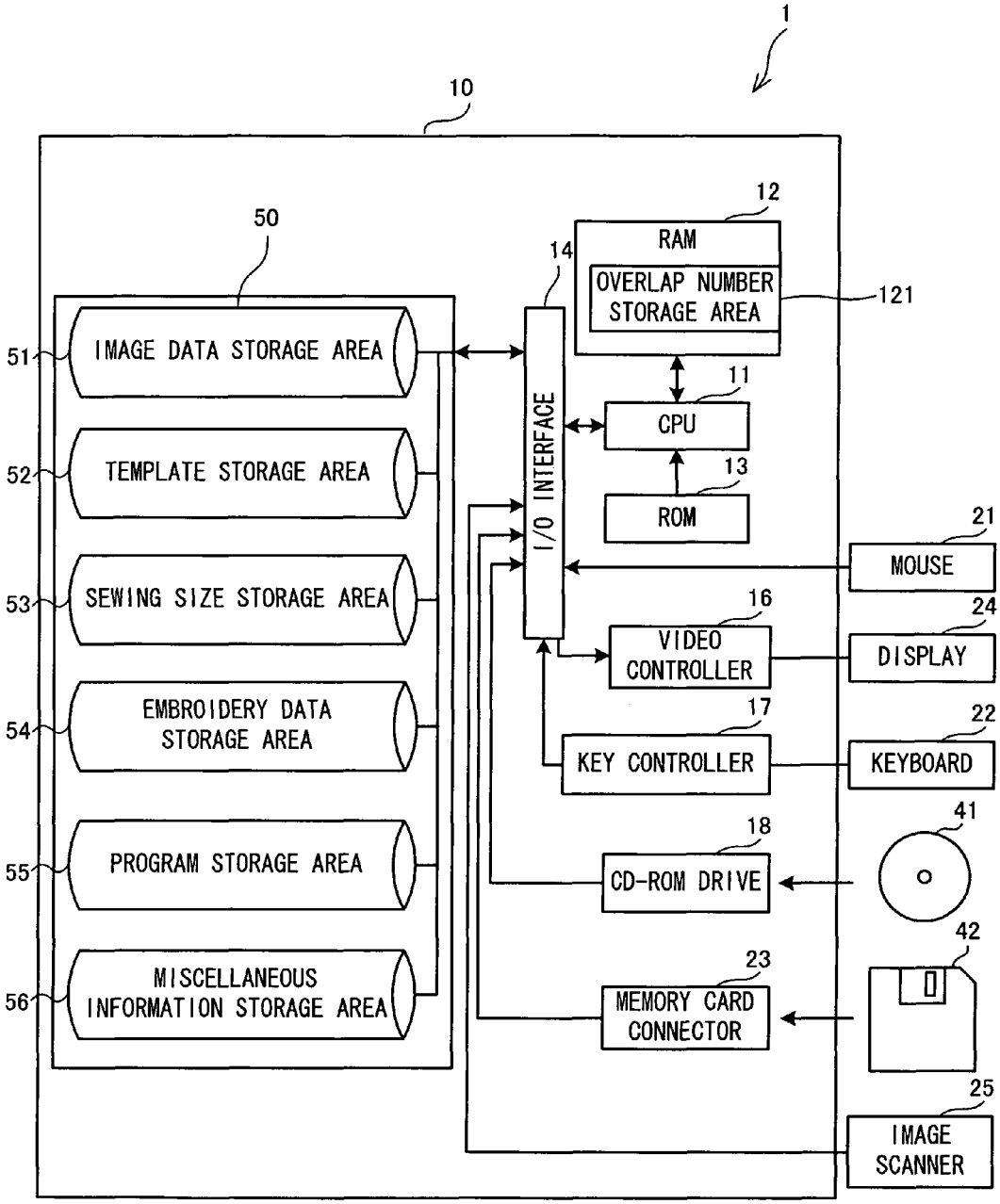
FIG. 2 is a block diagram showing an electrical configuration of an embroidery data generating apparatus.

Next, the embroidery data generating apparatus 1 will be described below with reference to FIGS. 2 and 3. As shown in FIG. 2, the embroidery data generating apparatus 1 comprises an apparatus body 10, such as, for example, a personal computer, and a mouse 21, a keyboard 22, a display 24, and an image scanner 25 which are connected to the apparatus body 10.

The embroidery data generating apparatus 1 is equipped with a CPU 11 as a controller that controls the embroidery data generating apparatus 1. The CPU 11 is connected to a RAM 12, a ROM 13 in which a BIOS etc. are stored, and an I/O interface 14. The RAM 12 has an overlap number storage area 121. The overlap number storage area 121 stores an overlap number, which is a permitted number of overlaps between an individual piece of image data to be disposed and another piece of image data. In the present embodiment, for example when an overlap number "1" is stored as the overlap number, the size of a piece of image data will be changed or templates having non-overlapping images will be selected to prevent images from overlapping with each other.

The I/O interface 14 is connected to a hard disk drive 50. The hard disk drive 50 has at least an image data storage area 51, a template storage area 52, a sewing size storage area 53, an embroidery data storage area 54, a program storage area 55, and a miscellaneous information storage area 56.

The image data storage area 51 stores image data, which is original embroidery data, such as image data loaded by the image scanner 25, for example. The template storage area 52 stores a variety of templates, each of which is constituted of a rectangular frame that indicates a position to which an image is to be disposed. The sewing size storage area 53 stores the image data corresponding to the size of a sewing range for the embroidery and a frame that represents this size. The embroidery data storage area 54 stores the embroidery data which is generated from the image data. The program storage area 55 stores an embroidery data generating program which is executed by the CPU 11. The miscellaneous information storage area 56 stores other information which is used in the embroidery data generating apparatus 1. If the embroidery data generating apparatus 1 is not equipped with a hard disk drive 50, the program is stored in the ROM 13.

The I/O interface 14 is connected to the mouse 21, a video controller 16, a key controller 17, a CD-ROM drive 18, a memory card connector 23, and the image scanner 25. The video controller 16 is connected to the display 24. The key controller 17 is connected to the keyboard 22. A CD-ROM 41, which is to be inserted into a CD-ROM drive 18, stores the embroidery data generating program. The embroidery data generating program is a control program for the embroidery data generating apparatus 1, so that when the control program is introduced, the control program will be loaded to the hard disk drive 50 from the CD-ROM 41 and stored in the program storage area 55. The memory card connector 23 makes it possible to load data from and write data to the memory card 42.

Next, operations in the embroidery data generating apparatus 1 having the above-described configuration are described below with reference to FIGS. 3-10. In the present embodiment, data pieces composed of principal data (main data) and other data (sub-data) will be easily disposed to thereby generate embroidery data. For example, after photo data is loaded, other image data is disposed around the photo data to thereby generate embroidery data.

Figure 3:
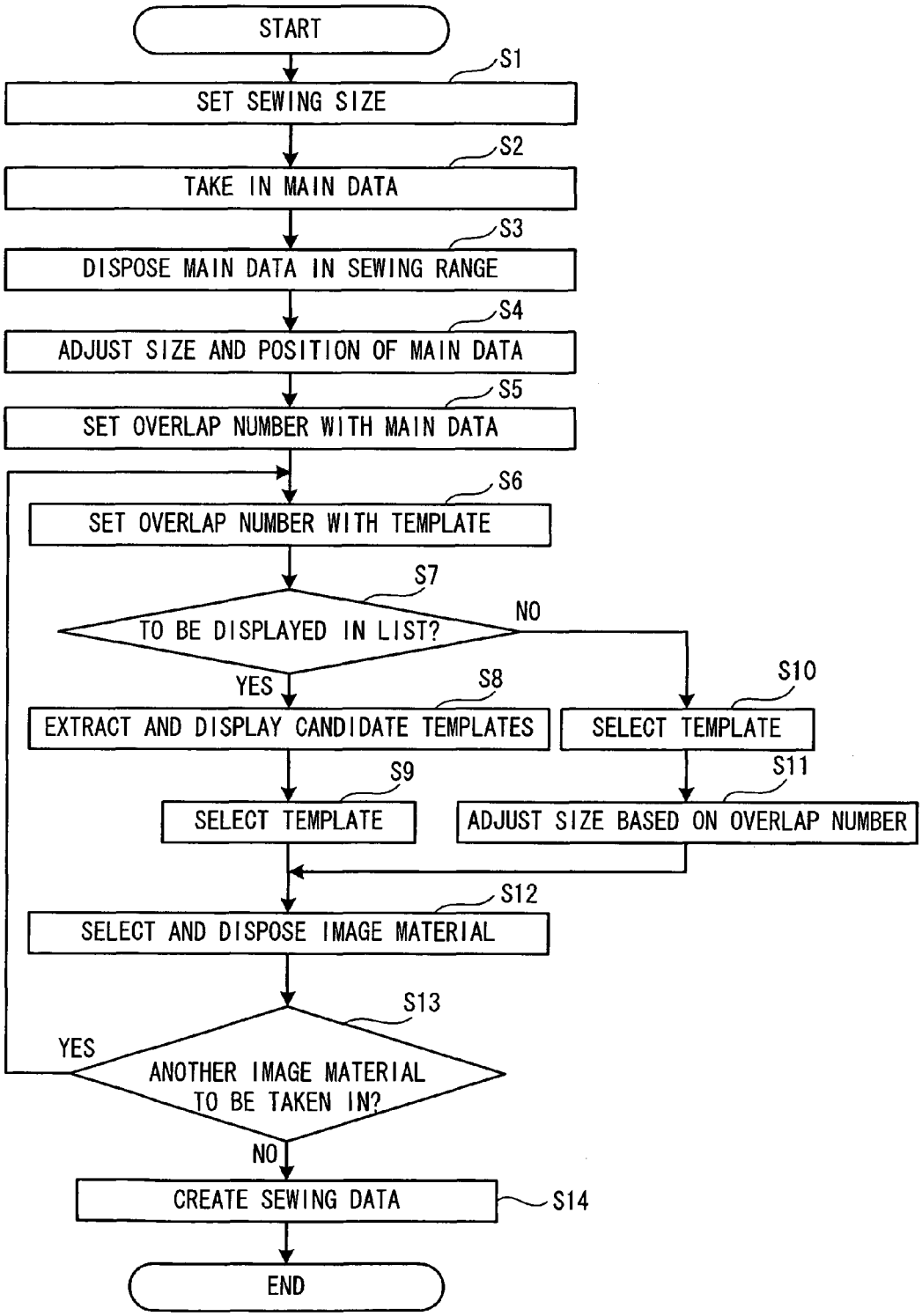
FIG. 3 is a flowchart of an embroidery data generating processing.

Once embroidery data generation processing starts, as shown in FIG. 3, the process first accepts the setting of a sewing size from an operator in step 1 (S1). Several values of the sewing size are stored in advance in the sewing size storage area 53 of the hard disk drive 50. When a sewing size setting command is selected, the sewing sizes are displayed so that one of the sizes can be selected. The selected sewing size is displayed on the processing screen 100, like, for example, a sewing range 200 as shown in FIG. 4.

Next, in step 2 (S2), main data that the operator desires to use as a center pattern for embroidery sewing is accepted. For example, photo data 110 is exemplified in FIG. 4 as the main data. The photo data 110 may be taken in directly from the image scanner 25 or may be loaded as data that has been stored in the image data storage area 51.

Figure 4:
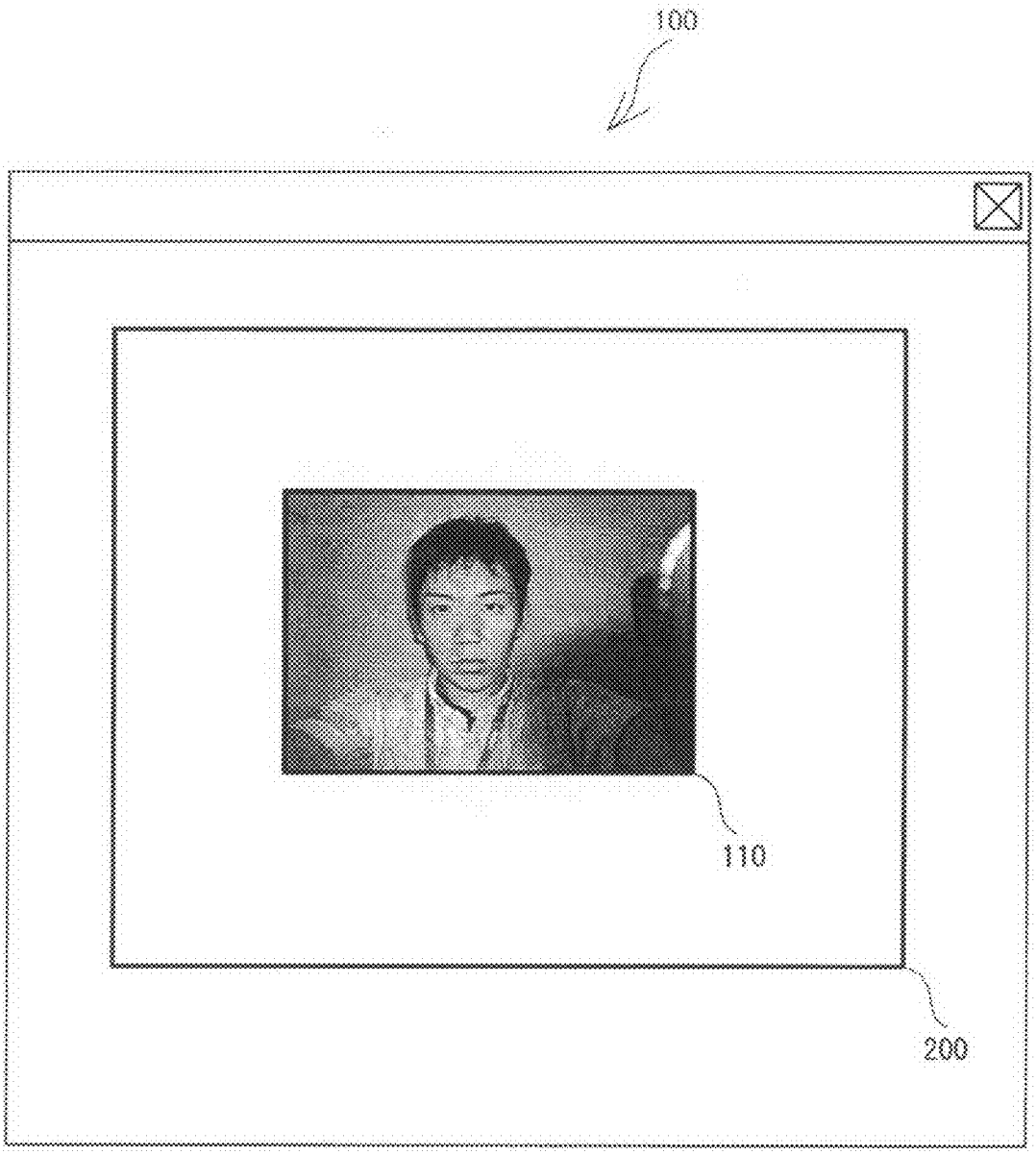
FIG. 4 is an explanatory diagram showing an example of a processing screen in a condition where received photo data is displayed.

Next, in step 3 (S3), the photo data 110 is disposed at the midsection of the sewing range as a default and is displayed on the processing screen 100 as shown in FIG. 4. The present embodiment disposes the main data and the sub-data in combination with each other to thereby generate an embroidery data. The main data preferably is disposed at the center if possible. The default disposition location is not limited to the midsection. For example, the default position location may be set by the operator to any location along the sewing range.

Next, in step 4 (S4) modifications of the size and the adjustment of the position of the main data disposed at S3 are accepted. The operator can change the size of the photo data 110 by using the mouse 21 to adjust the position of the photo data 110 by clicking and dragging the mouse 21, for example. Methods of modifying the size and adjusting the position are not limited to use of the mouse 21. For example, another method may be employed, such as entering a value through the keyboard 22 or providing buttons on the screen 100.

Next, in step 5 (S5), an overlap number to the photo data 110, the main data in this case is accepted. The overlap number indicates whether to permit any other data to overlap with the main data and, if it is permitted, the maximum number of the permitted overlaps. If the operator does not desire to dispose sub-data overlapping with the main data, the overlap number is set to "1". If the overlap number is "2", the main data can tolerate one template to overlap it. In accordance with the set overlap number, a template for the sub-data is disposed and its size is adjusted automatically, which will be described later. The overlap number is stored in the overlap number storage area 121 of the RAM 12.

Next, in step 6 (S6), the permitted overlap number of the other data (main data or any other templates) to the template for the sub-data to be input is set. In the present embodiment, when taking in sub-data to be disposed around the main data, before taking in the sub-data directly, a rectangular template is used to determine where to dispose the sub-data. The overlap number is set to the template to determine whether to permit any other data to overlap with the template. If it is permitted, the overlap number is set to the maximum number of the permitted overlaps. The overlap number is set with the main data as well as the sub-data, so that in automatic disposition, either one of the main data and sub-data is processed preferentially according to whichever is smaller in overlap number, which will be described later.

Next, in step 7 (S7), it is determined whether to display a list of candidate templates for the sub-data that can be disposed around the main data. In the present embodiment, there are two methods of disposing the template for the sub-data. In one method, a list of candidate templates whose size and position are already adjusted based on the overlap number is displayed. The operator may select one of them. In the other method, the operator first selects one of the default templates that has a specified disposition location and size, and the size of the template is changed based on an overlap number. At S7, it is determined which one of these methods should be selected. The method may be selected by the operator or may be determined in advance at an initial setting.

Figure 5:
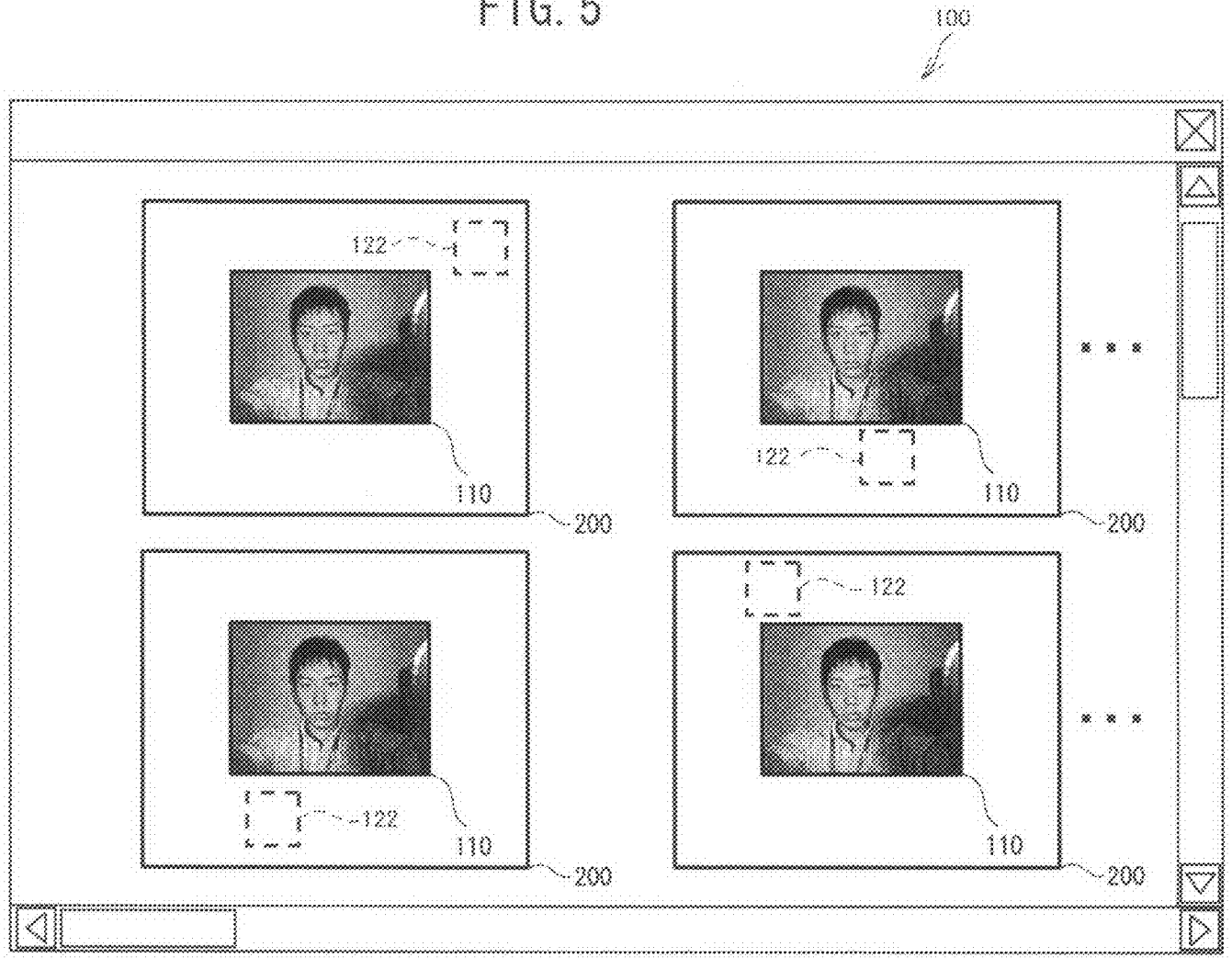
FIG. 5 is an explanatory diagram showing an example of a processing screen on which a list of templates is displayed.

When it is decided to display the list of template candidates (YES at S7), in step 8 (S8) available templates 122 are extracted from among the templates stored in the template storage area 52 based on the overlap number set at S5 and S6 and displayed in a list, for example, as shown in FIG. 5. For example, in FIG. 5, the overlap number to the main data and to the template are both "1". The displayed templates 122 are already adjusted so that they may not overlap with the main data. A variety of sizes of templates may be stored in the template storage area 52, or the sizes may be adjusted taking into account the overlap number, to thereby create candidates. Subsequently, in step 9 (S9) the selection made by the operator of one of the template candidates is accepted. If none of the templates is selected, the process may return to S7 or the processing may be re-started from S2 for the taking-in of the main data or may be re-started from S4 for the adjustment of the size and the position of the template.

Figure 6:
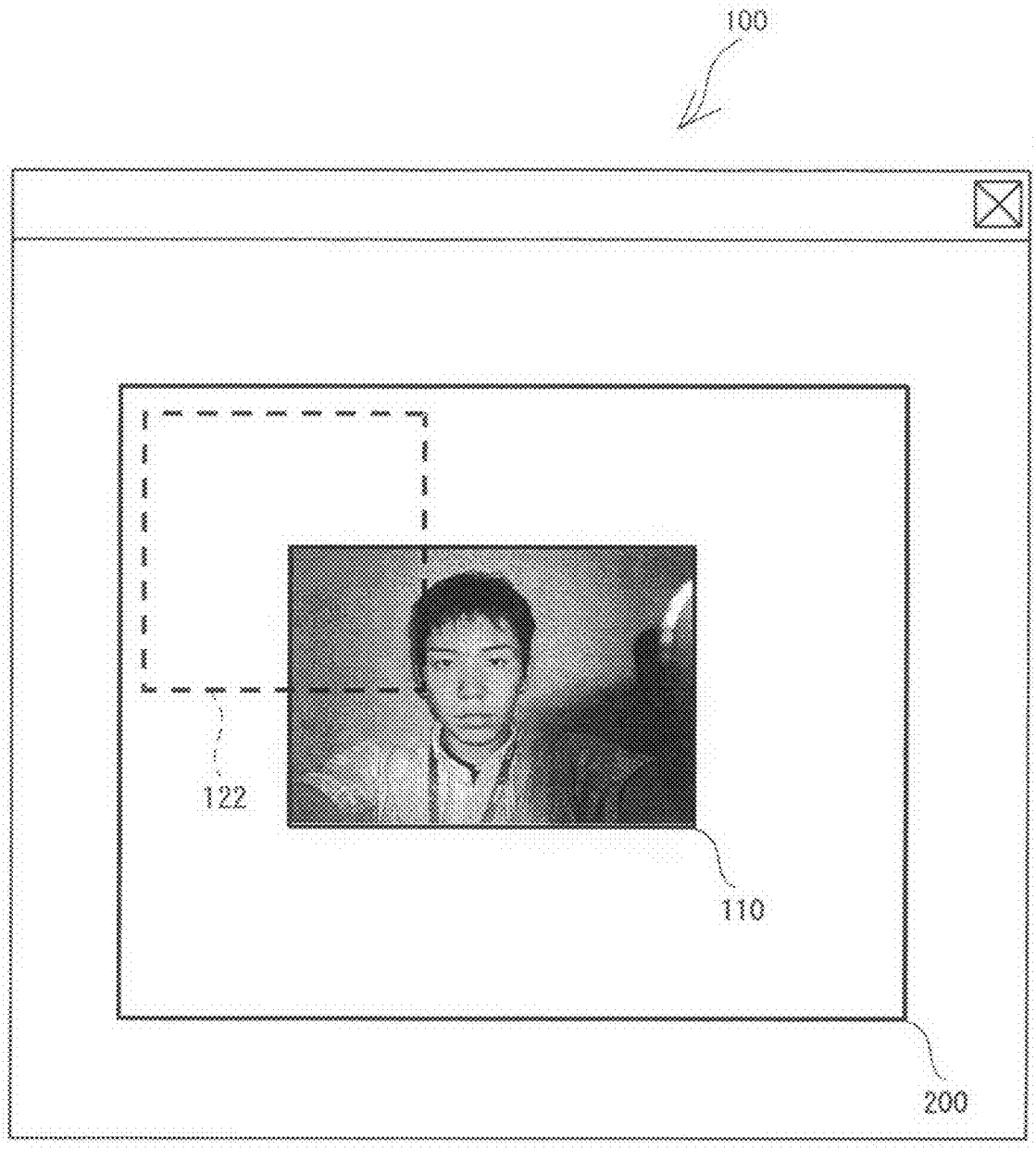
FIG. 6 is an explanatory diagram showing an example of the processing screen in a condition where the template is disposed initially.
Figure 7:
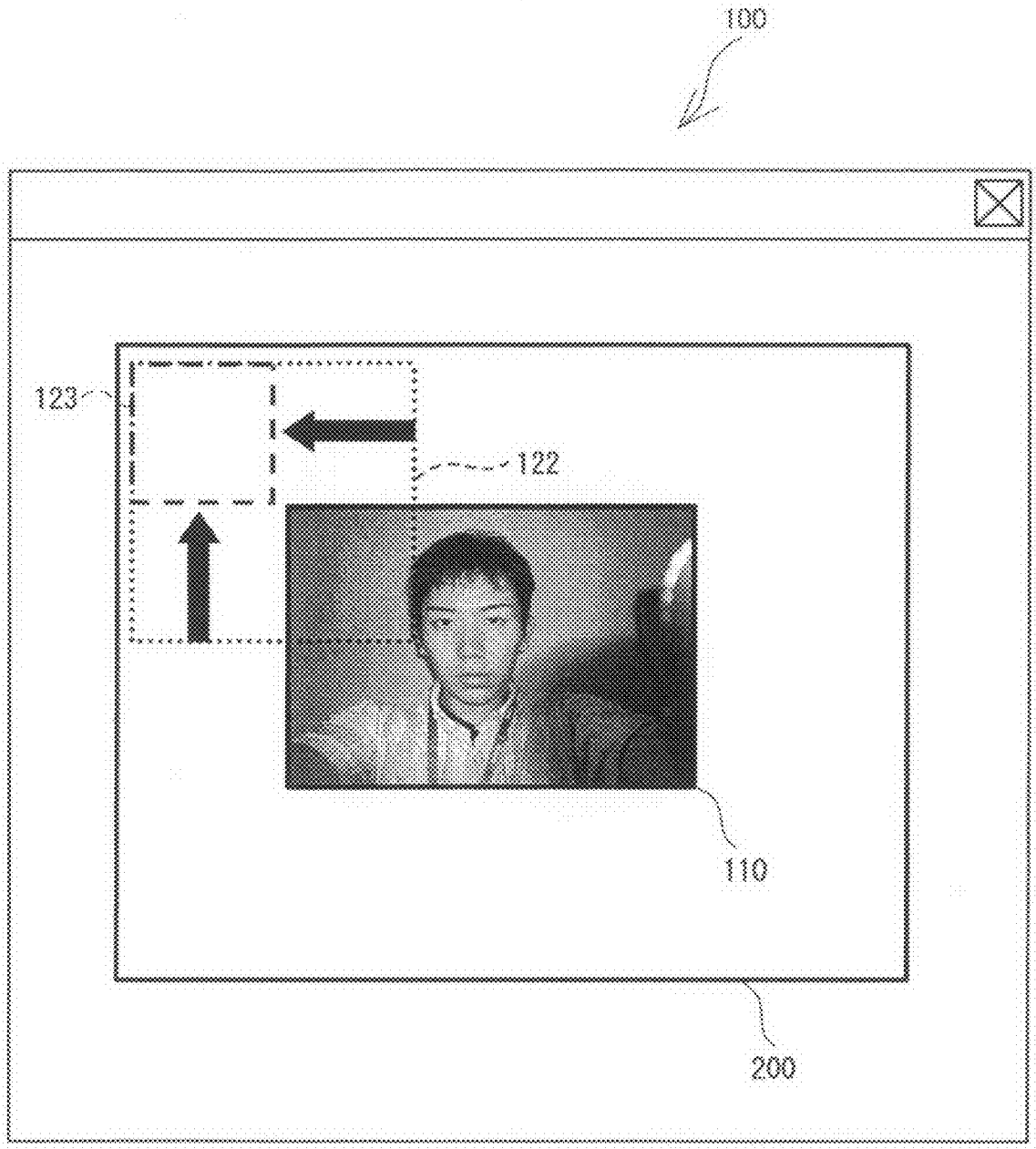
FIG. 7 is an explanatory diagram showing an example of the processing screen after the template is disposed automatically.

When it is decided not to display the list of the template candidates (NO at S7), in step 10 (S10) the process accepts the selection of a template for the sub-data. The operator may select a template based on the disposition location without taking into account the overlap between the main data and the sub-data. This is a template 122 (hereinafter referred to as "first template 122") shown in FIG. 6. Next, in step 11 (S11), the size of the template is adjusted based on the overlap number set at S5 and S6. If the overlap number to the main data and to the template are both set to "1", the main data and the sub-data are not permitted to overlap with each other. The size of the template is reduced so as not to overlap with the main data, by using a predetermined point as a base point. The base point is determined beforehand for each template. The base point can be set to any one of the four vertices of the template or to a predetermined point on its four sides. Since the first template 122 is disposed to the upper left of the sewing range in FIG. 6, the upper left vertex is defined as the base point. After being scaled down, it becomes a template 123 shown in FIG. 7. Hereinafter, the first template after size reduction is referred to as "first template 123". If the overlap number to either the main data or the template is "1" and the overlap number to the other data is "2" or greater, the main data or the template, whichever is smaller in overlap number, has priority, so that the processing is performed with the overlap number of "1", thus resulting in such a scale-down as shown in FIG. 7. If the overlap number to the main data and to the template are both "2" or greater, overlapping is permitted. Accordingly, template input in a state shown in FIG. 6 is not adjusted.

Figure 8:
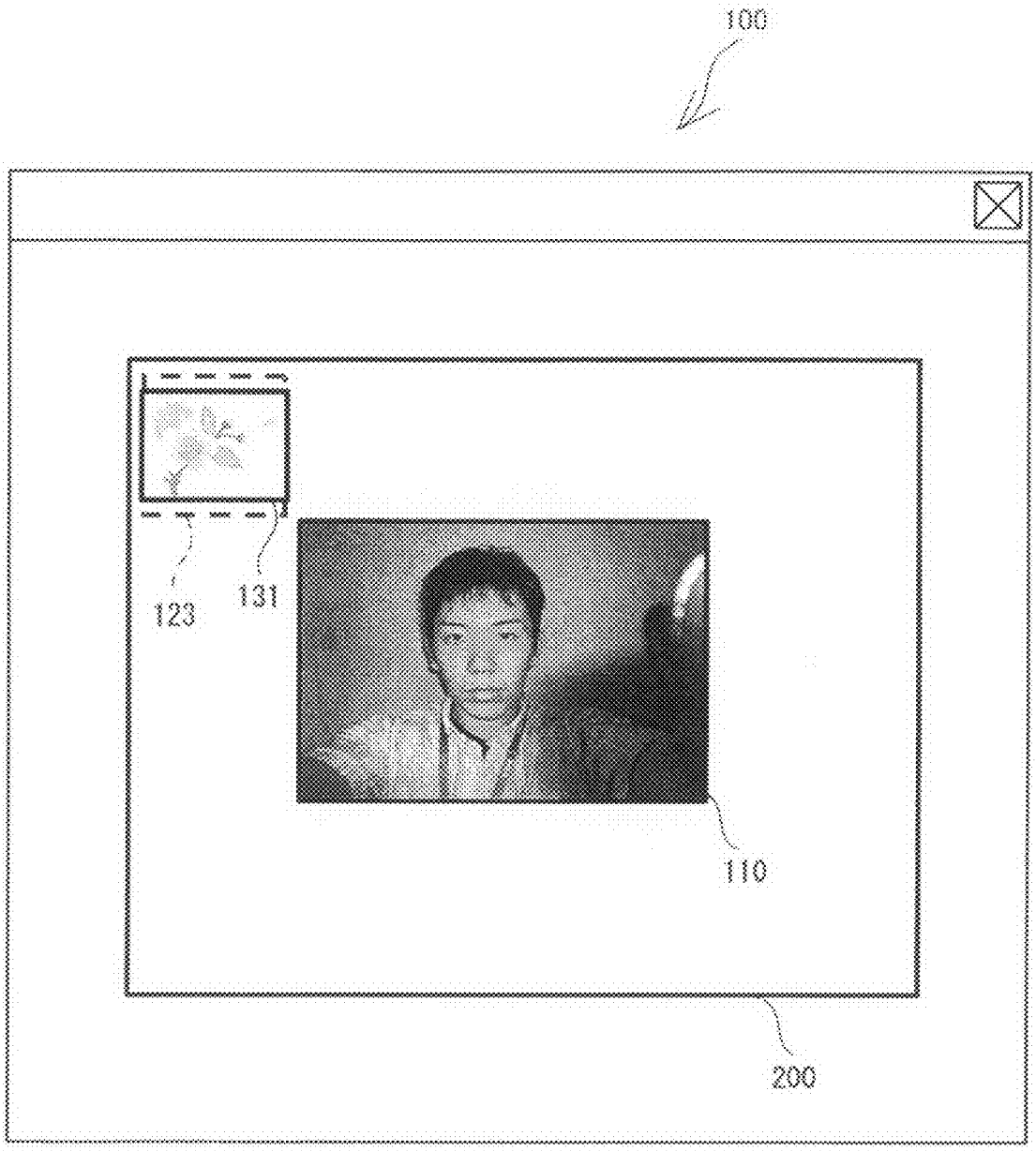
FIG. 8 is an explanatory diagram showing an example of the processing screen on which screen material is disposed in a template.

Next, in step 12 (S 12), an image material 131 (as shown in FIG. 8) is taken into the frame of the template determined at S9 or S11. Similar to the photo data 110, the image material 131 may be taken in from the image scanner 25, or the data stored in the image data storage area 51 may be loaded. In the present embodiment, as shown in FIG. 8, the image material 131 is disposed to the center of the first template 123. The image material 131 is scaled up or down from its original data so that the image material 131 may fit the first template 123 in size. Before the image material 131 is taken in at S12, the operator may adjust the disposition location and the size of the template. By doing so, adjustments of the disposition location and the size will be made automatically. The operator can create desired original data by further adjusting the disposition location and the size manually.

Next, in step 13 (S13), a decision is made as to whether to take in another image material (sub-data). When it is decided to take in another sub-data (YES at S13), the process returns to S6 to perform the same processing as that which was performed for the first template. That is, an overlap number to the new sub-data is set (S6), a template is selected and disposed (S8-S11), and the sub-data is taken into a determined template (S12). Hereinafter, the template that is selected second is referred to as a "second template 124". The following describes a case where the second template is not displayed in a list form (NO at S7) and, after a template is selected (S11), the size of the template is automatically adjusted taking into account an overlap number that is set to the template (S11).

Figure 9:
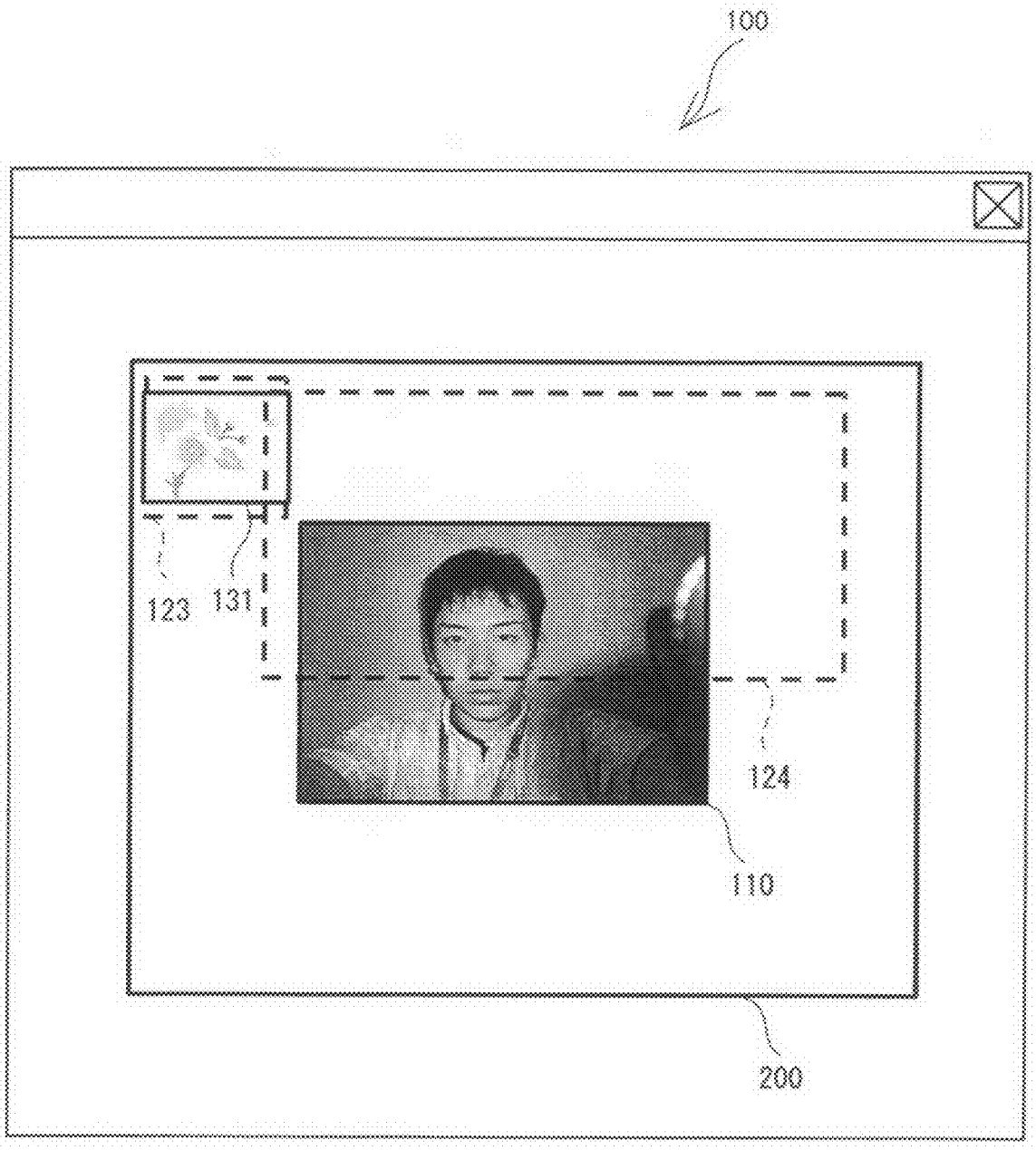
FIG. 9 is an explanatory diagram showing an example of the processing screen in a condition where a second template is disposed initially.
Figure 10:
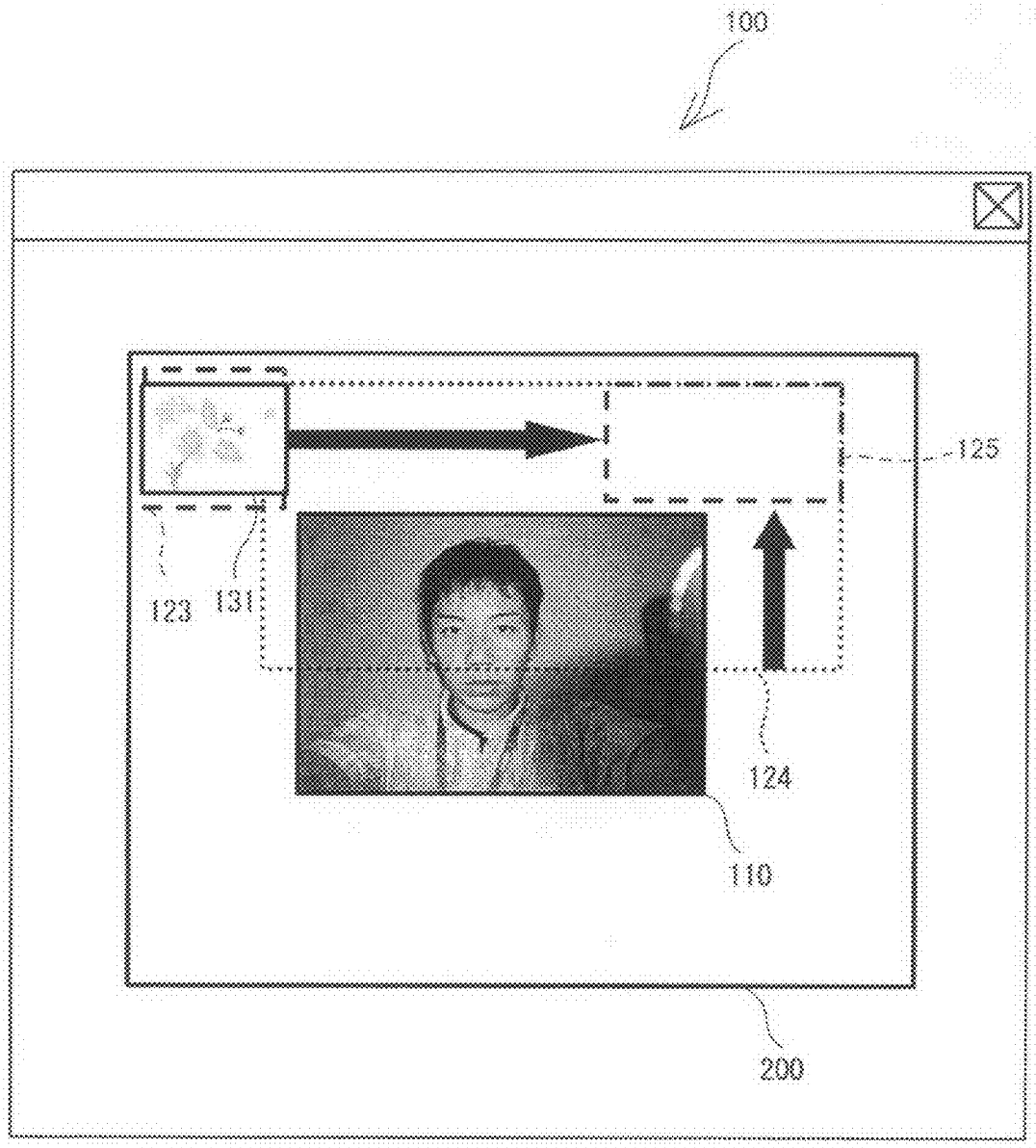
FIG. 10 is an explanatory diagram showing an example of the processing screen after the second template is disposed automatically.

When a second template 124 is selected, as shown in FIG. 9, and when the overlap numbers to the photo data 10 and the first template 123 are both "1", or if the overlap number for the second template 124 is "1", the second template 124 is not permitted to overlap with the photo data 10 or with the first template 123. In such a case, the size of the second template 124, which was selected more recently, is changed. As shown in FIG. 10, the base point of the second template 124 is the upper right vertex. The template is scaled down using the upper right vertex as the base point so that the template may not overlap to the photo data 10 or the first template 123, thus providing a modified second template 125. The base point required for changing the size of the template is not limited to one vertex. For example, a plurality of vertex candidates may be determined for each template so that one of the templates can be selected taking into account a correlation with the data that has already been determined. For example, in the case of the second template 124, the photo data 110 is disposed to a lower part of the sewing range 200 and the first template 123 is disposed to a left part of the sewing range 200, so that the upper right vertex of the second template 124 is employed as the base point. If there is no first template 123 but only the photo data 110, the base point may be at the midsection on the upper side or the upper left vertex of the second template 124. The operator may select the base point from among those candidates. Furthermore, instead of reducing the size of a template in a similar shape, the template may be scaled down using a side rather than a point as its baseline.

In another case where the overlap number to the photo data 110 is "1" and the overlap numbers of the first template 123 and the second template 124 are both "2", the first template 123 and the second template 124 are permitted to overlap with each other. In this case, the second template 124 may be scaled down in upward adjustment by using the upper side as a baseline until the upper side reaches a position in which it will not overlap with the photo data 110. In a further case where the overlap number to the first template 123 is "1" and those to the photo data 110 and the second template 124 are both "2", the photo data 110 and the second template 124 are permitted to overlap with each other. In such a case, the second template 124 also may be scaled down using the upper right vertex as its base point until it reaches a position in which it will not overlap with the first template 123.

When no other sub-data is to be taken in (NO at S13), the process combines the main data and the sub-data which have been taken in by the above processing to thereby generate an embroidery sewing data (S14). To generate the sewing data, a known method disclosed in, for example, Japanese Patent Application Laid Open Publication No. 2001-259268 is employed. This method is outlined below. First, the angular characteristic and its intensity are calculated for each pixel of image data determined by the above processing. Next, based on the angular characteristic and its intensity, a line segment data is generated. Part of the generated line segment data is deleted so that it may not be inappropriate embroidery data. Subsequently, the color component is determined for each of the line segment data pieces. Further, the line segment data is analyzed in a condition where the color component is added and then appropriately modified. Then, embroidery sewing data is generated based on a group of the line segment data pieces. In generating the embroidery sewing data, for each of the same color components, the start point and the end point of the line segment are converted into the start point and the end point of a stitch respectively. When the embroidery sewing data is generated in such a manner, the embroidery data generating processing ends.

As described above, according to the embroidery data generating apparatus in the present embodiment, main data is taken in, the position and size of the main data are determined, and a desired sub-data to be used together with the main data is disposed. The disposition of the sub-data is set on the basis of the overlap numbers to both the main data and the sub-data respectively, so that if the overlap numbers for the main data and the sub-data are "1", the position and the size of the templates will be automatically adjusted so that they do not overlap with each other. The operator does not have to adjust the disposition and the size of data. By specifying a desired data of a principal pattern in advance, the other data will be adjusted appropriately as an accessory pattern. Therefore, the original image data for embroidery data can be easily generated so that embroidery sewing data can be generated in accordance with the original image data.

It should be noted that the configuration of the embroidery data processing apparatus 1 described in the above embodiment is exemplary and can be modified in various forms. The above-described embodiment determines the disposition and the size of image material (sub-data) by using a template before loading the sub-data. However, instead of using a template, the sub-data may be loaded directly, and then adjusted in disposition and size. In this case, the sub-data may be loaded before S6, instead of before S12.

What is claimed is:

1. An embroidery data processing apparatus that generates embroidery sewing data for sewing an embroidery pattern, the apparatus comprising:

a main data loading device that loads main data, which is original data of a principal pattern;

a main data disposition device that disposes in an embroidery sewing region the main data loaded by the main data loading device;

a sub-data loading device that loads sub-data, which is original data of one or more patterns other than the principal pattern;

a sub-data disposition determination device that determines a position and a size of the sub-data loaded by the sub-data loading device, in accordance with a position and a size of the main data disposed by the main data disposition device;

an embroidery sewing data generating device that generates embroidery sewing data based on the main data disposed by the main data disposition device and the sub-data determined by the sub-data disposition determination device; and an overlap number setting device that sets a permitted number of overlaps of each of the main data and the sub-data, wherein the sub-data disposition determination device determines the position and the size of the sub-data in accordance with the overlap number set by the overlap number setting device.

2. The embroidery data processing apparatus according to claim 1, wherein if there is other sub-data whose disposition is already determined, the sub-data disposition determination device determines the position and the size of the sub-data corresponding to the position and the size of the main data and the position and the size of the other sub-data.

3. The embroidery data processing apparatus according to claim 1, wherein the main data is image data.

4. An embroidery data processing apparatus that generates embroidery sewing data for sewing an embroidery pattern, the apparatus comprising:

a main data loading device that loads main data, which is original data of a principal pattern;

a main data disposition device that disposes in an embroidery sewing region the main data loaded by the main data loading device;

a sub-data loading device that loads sub-data, which is original data of one or more patterns other than the principal pattern;

a sub-data disposition determination device that determines a position and a size of the sub-data loaded by the sub-data loading device, in accordance with a position and a size of the main data disposed by the main data disposition device;

an embroidery sewing data generating device that generates embroidery sewing data based on the main data disposed by the main data disposition device and the sub-data determined by the sub-data disposition determination device;

a sub-data disposition candidate creating device that extracts from a plurality of candidates a candidate for the sub-data to be disposed corresponding to the position and the size of the main data disposed by the main data disposition device; and a selection device that selects one of the candidates created by the sub-data disposition candidate creating device, wherein the sub-data disposition determination device determines the position and the size of the sub-data based on the candidate selected by the selection device.

5. The embroidery data processing apparatus according to claim 4, wherein if there is other sub-data whose disposition is already determined, the sub-data disposition determination device determines the position and the size of the sub-data corresponding to the position and the size of the main data and the position and the size of the other sub-data.

6. The embroidery data processing apparatus according to claim 4, wherein the main data is image data.

7. An embroidery data processing program recorded in a non-transitory computer-readable recording medium, the program comprising instructions that cause a controller to perform:

a main data loading step of loading main data, which is original data of a principal pattern;

a main data disposition step of disposing in an embroidery sewing region the main data loaded in the main data loading step;

a sub-data loading step of loading sub-data, which is original data of one or more patterns other than the principal pattern;

a sub-data disposition determination step of determining a position and a size of the sub-data loaded in the sub-data loading step, in accordance with a position and a size of the main data disposed in the main data disposition step;

an embroidery sewing data generating step of creating embroidery sewing data based on the main data disposed in the main data disposition step and the sub-data determined in the sub-data disposition determination step; and an overlap number setting step of setting a permitted number of overlaps of each of the main data and the sub-data, wherein the sub-data disposition determination step determines the position and the size of the sub-data in accordance with the overlap number set at the overlap number setting step.

8. The embroidery data processing program according to claim 7, wherein if there is other sub-data whose disposition is already determined, the sub-data disposition determination step determines the position and the size of the sub-data corresponding to the position and the size of the main data and the position and the size of the other sub-data.

9. The embroidery data processing program according to claim 7, wherein the main data is image data.

10. An embroidery data processing program recorded in a non-transitory computer-readable recording medium, the program comprising instructions that cause a controller to perform:

a main data loading step of loading main data, which is original data of a principal pattern;

a main data disposition step of disposing in an embroidery sewing region the main data loaded in the main data loading step;

a sub-data loading step of loading sub-data, which is original data of one or more patterns other than the principal pattern;

a sub-data disposition determination step of determining a position and a size of the sub-data loaded in the sub-data loading step, in accordance with a position and a size of the main data disposed in the main data disposition step;

an embroidery sewing data generating step of creating embroidery sewing data based on the main data disposed in the main data disposition step and the sub-data determined in the sub-data disposition determination step;

a sub-data disposition candidate creating step of creating from a plurality of candidates a candidate for the sub-data to be disposed corresponding to the position and the size of the main data disposed at the main data disposition step; and a selection step of selecting one of the candidates created at the sub-data disposition candidate extracting step, wherein the sub-data disposition determination step determines the position and the size of the sub-data based on the candidate selected at the selection step.

11. The embroidery data processing program according to claim 10, wherein if there is other sub-data whose disposition is already determined, the sub-data disposition determination step determines the position and the size of the sub-data corresponding to the position and the size of the main data and the position and the size of the other sub-data.

12. The embroidery data processing program according to claim 10, wherein the main data is image data.

* * * * *